US011306368B2

(12) United States Patent
Wang et al.

(10) Patent No.: US 11,306,368 B2
(45) Date of Patent: Apr. 19, 2022

(54) HIGH PRESSURE AND CORROSION RESISTANT STEEL AND PREPARATION METHOD AND APPLICATION THEREOF

(71) Applicant: Shanghai Qinghe Machinery CO., LTD., Shanghai (CN)

(72) Inventors: He Wang, Shanghai (CN); Yang Li, Shanghai (CN); Jiegao Fei, Shanghai (CN); Yongliang Xin, Shanghai (CN)

(73) Assignee: SHANGHAI QINGHE MACHINERY CO., LTD., Shanghai (CN)

( * ) Notice: Subject to any disclaimer, the term of this patent is extended or adjusted under 35 U.S.C. 154(b) by 199 days.

(21) Appl. No.: 16/553,715

(22) Filed: Aug. 28, 2019

(65) Prior Publication Data

US 2020/0392594 A1 Dec. 17, 2020

(30) Foreign Application Priority Data

Jun. 12, 2019 (CN) ..... 201910504697.9

(51) Int. Cl.

| | |
|---|---|
| ***C21D 8/00*** | (2006.01) |
| ***C22C 38/58*** | (2006.01) |
| ***C22C 38/46*** | (2006.01) |
| ***C22C 38/44*** | (2006.01) |
| ***C22C 38/42*** | (2006.01) |
| ***C22C 38/06*** | (2006.01) |
| ***C22C 38/02*** | (2006.01) |
| ***C22C 38/00*** | (2006.01) |
| ***C21D 6/00*** | (2006.01) |

(52) U.S. Cl.

CPC ..... *C21D 8/005* (2013.01); *C21D 6/004* (2013.01); *C21D 6/005* (2013.01); *C21D 6/008* (2013.01); *C22C 38/001* (2013.01); *C22C 38/002* (2013.01); *C22C 38/008* (2013.01); *C22C 38/02* (2013.01); *C22C 38/06* (2013.01); *C22C 38/42* (2013.01); *C22C 38/44* (2013.01); *C22C 38/46* (2013.01); *C22C 38/58* (2013.01)

(58) Field of Classification Search

CPC ..... C21D 6/004; C21D 6/005; C21D 6/008; C21D 8/005; C22C 38/001; C22C 38/002; C22C 38/008; C22C 38/02; C22C 38/06; C22C 38/42; C22C 38/44; C22C 38/46; C22C 38/58

See application file for complete search history.

(56) References Cited

U.S. PATENT DOCUMENTS 4,664,701 A * 5/1987 Royzman ..... C21C 5/567 75/10.42

FOREIGN PATENT DOCUMENTS

| | | | |
|---|---|---|---|
| CN | 102433503 A | | 5/2012 |
| CN | 108546812 A | * | 9/2018 |
| CN | 108546812 A | | 9/2018 |

* cited by examiner

*Primary Examiner* — Jenny R Wu

(74) *Attorney, Agent, or Firm* — Berenato & White, LLC

(57) ABSTRACT

The present invention belongs to the technical field of alloy materials, and particularly relates to high pressure and corrosion resistant steel and a preparation method and an application thereof. The high pressure and corrosion resistant steel provided by the present invention has a tensile strength of 1,020-1,100 MPa, a yield strength of 980-1,050 MPa, an elongation of 20%-22%, a reduction of area of 60%-80%, and impact energy of more than 100 J at a low temperature of 40° C., and has excellent high pressure and corrosion resistance.

16 Claims, No Drawings

HIGH PRESSURE AND CORROSION RESISTANT STEEL AND PREPARATION METHOD AND APPLICATION THEREOF

This application claims priority to Chinese application number 201910504697.9, filed Jun. 12, 2019, with a title of HIGH PRESSURE AND CORROSION RESISTANT STEEL AND PREPARATION METHOD AND APPLICATION THEREOF. The above-mentioned patent application is incorporated herein by reference in its entirety.

TECHNICAL FIELD

The present invention belongs to the technical field of alloy materials, and particularly relates to high pressure and corrosion resistant steel and a preparation method and an application thereof.

BACKGROUND

With the continuous exploitation of existing oilfield resources and the decreasing of oil well production in the world, acid fracturing (a mining technique in which acid liquor instead of proppant is used for fracturing above a formation fracture pressure and a fracture surface is not completely closed after a pump is stopped to release pressure) has now become one of the most effective measures to improve the recovery ratio of oil-gas wells. Therefore, high power, large displacement and acid corrosion resistant fracturing equipment is required for the exploitation of low permeability oil-gas wells and deep oil-gas wells.

A fracturing pump is a core part of a fracturing truck in the fracturing equipment. The working principle of the fracturing pump is to make use of hydraulic action to form a fracture in an oil reservoir, squeeze liquid of certain viscosity into the oil reservoir under a high pressure and large displacement condition, and after the oil reservoir is pressed to form many fractures, add a proppant to promote the oil reservoir to seep out. It can be seen that the working performance of a fracturing pump directly affects the exploitation efficiency of an oil field. The material of a traditional fracturing pump is mainly AISI4330 steel, which has high strength and toughness, but has a short service life in a fracturing environment and cannot meet modern and future fracturing environments.

SUMMARY

An objective of the present invention is to provide high pressure and corrosion resistant steel, which has excellent high pressure and corrosion resistance and a long service life in a fracturing environment, and is suitable as a material for manufacturing a fracturing pump.

To achieve the above purpose, the present invention provides the following technical solutions.

The present invention provide high pressure and corrosion resistant steel, including the following components by mass percentage: 0.05%-0.15% of C, 3.35%-3.65% of Mn, 0.10%-0.28% of Si, 0.8%-1.20% of Cr, 1.35%-1.65% of Ni, 0.35%-0.45% of Mo, 0.25%-0.35% of V, 0.85%-1.20% of Cu, 0.015%-0.045% of Al, ≤0.001% of S, ≤0.010% of P, ≤0.010% of Sn, ≤0.008% of Sb, ≤0.010% of As, ≤0.008% of Pb, ≤1.5 ppm of H, ≤30 ppm of O, ≤70 ppm of N, and the balance being Fe.

Preferably, the high pressure and corrosion resistant steel includes the following components by mass percentage: 0.05%-0.12% of C, 3.37%-3.63% of Mn, 0.12%-0.27% of Si, 0.85%-1.15% of Cr, 1.35%-1.65% of Ni, 0.35%-0.45% of Mo, 0.27%-0.34% of V, 0.87%-1.19% of Cu, 0.0018%-0.043% of Al, ≤0.0008% of S, ≤0.009% of P, 0.001%-0.009% of Sn, 0.0001%-0.007% of Sb, ≤0.008% of As, 0.0001%-0.008% of Pb, ≤1.2 ppm of H, ≤25 ppm of O, ≤67 ppm of N, and the balance being Fe.

The present invention provide a preparation method of the above-described high pressure and corrosion resistant steel, including the following steps:

(1) sequentially smelting and casting raw materials corresponding to the respective components in the high pressure and corrosion resistant steel according to claim 1 or 2 to obtain a steel ingot;

(2) hot-forging the steel ingot to obtain a forged piece; and (3) heat-treating the forged piece to obtain the high-pressure and corrosion resistant steel.

Preferably, in step (1), the smelting includes sequential fusion, refining and degassing.

Preferably, in step (2), a hot-forging temperature is 850-1,200° C., and a deformation is 45%-55%.

Preferably, in step (2), a total forging ratio of hot-forging is ≥5.

Preferably, in step (3), the heat treatment includes a first stage of heat treatment, a second stage of heat treatment and a third stage of heat treatment;

the method of the first stage of heat treatment includes:

heating the forged piece to 550±15° C., and waiting for insulation;

heating the to-be-insulated forged piece to 650±15° C., and carrying out 1st insulation;

after the 1st insulation, furnace-cooling the forged piece to 300±15° C., and carrying out 2nd insulation;

after the 2nd insulation, heating the forged piece to 450±15° C., and carrying out 3rd insulation;

after the 3rd insulation, heating the forged piece to 750±15° C., and carrying out 4th insulation;

after the 4th insulation, air-cooling the forged piece to ≤300° C., and carrying out 5th insulation;

after the 5th insulation, heating the forged piece to 450±15° C., and carrying out 6th insulation;

after the 6th insulation, heating the forged piece to 750±15° C., and carrying out 7th insulation;

after the 7th insulation, furnace-cooling the forged piece to 280±15° C., and carrying out 8th insulation;

after the 8th insulation, heating the forged piece to 680±15° C., and carrying out 9th insulation; and after the 9th insulation, furnace-cooling the forged piece to ≤65° C., and air-cooling to a room temperature.

Preferably, the method of the second stage of heat treatment is as follows:

heating the forged piece treated by the first stage of heat treatment from the room temperature to 500±10° C., and carrying out first insulation; then heating to 830-850° C., carrying out second insulation, and air-cooling to the room temperature;

then heating the forged piece from the room temperature to 500±10° C., and carrying out third insulation; then heating to 830-850° C., carrying out fourth insulation, and air-cooling to the room temperature; and finally heating the forged piece from the room temperature to 600±10° C., and carrying out fifth insulation; then heating to 580-620° C., carrying out sixth insulation, and oil-cooling to the room temperature.

Preferably, the method of the third stage of heat treatment is as follows:

heating the forged piece treated by the second stage of heat treatment from the room temperature to 350±10° C., and carrying out I-th insulation; then heating to 580-620° C., carrying out II-th insulation, and air-cooling to the room temperature.

The present invention provides an application of the above-described high pressure and corrosion resistant steel or high pressure and corrosion resistant steel prepared by the above-described preparation method as a material for manufacturing a fluid end valve chamber of a fracturing pump.

The present invention utilizes Mn to improve the stability of austenite at a room temperature, and provides a favorable condition for obtaining a dual-phase structure of tempered martensite and the austenite and improving the toughness and fatigue life of a steel material. The present invention further co-uses Cr, Ni and Cu of the amount and combines with a low-carbon design to further improve the corrosion resistance of the steel material; V and C in the steel material can precipitate to separate out VC, which can be used as a reinforcing phase to improve the strength property of the steel material. The results of embodiments show that the foregoing solution provided by the present invention can obtain a steel material having high strength, high toughness and high corrosion resistance, where a tensile strength is 1,020-1,100 MPa, a yield strength is 980-1,050 MPa, an elongation is 20%-22%, a reduction of area is 60%-80%, and impact energy is 100 J or more at a low temperature of −40° C.; the steel material can resist corrosion of hydrochloric acid with a mass concentration of 20%; and the service life of the steel material is 300 h or more when it is used under the condition of 80-140 MPa, 20% mass concentration hydrochloric acid and 1 $m^3$/min displacement.

DETAILED DESCRIPTION

The high pressure and corrosion resistant steel of the present invention refers to a steel material resistant to a pressure of 80-140 MPa.

The present invention provides high pressure and corrosion resistant steel, including the following components by mass percentage: 0.05%-0.15% of C, 3.35%-3.65% of Mn, 0.10%-0.28% of Si, 0.8%-1.20% of Cr, 1.35%-1.65% of Ni, 0.35%-0.45% of Mo, 0.25%-0.35% of V, 0.85%-1.20% of Cu, 0.015%-0.045% of Al, ≤0.001% of S, ≤0.010% of P, ≤0.010% of Sn, ≤0.008% of Sb, ≤0.010% of As, ≤0.008% of Pb, ≤1.5 ppm of H, ≤30 ppm of O, ≤70 ppm of N, and the balance being Fe.

The high pressure and corrosion resistant steel provided by the present invention includes the following components by mass percentage:

C: 0.05%-0.15%, preferably 0.05%-0.12%, more preferably 0.06%-0.10%, and most preferably 0.065%-0.09%;

Mn: 3.35%-3.65%, preferably 3.37%-3.63%, more preferably 3.40%-3.60%, and most preferably 3.45%-3.60%;

Si: 0.10%-0.28%, preferably 0.12%-0.27%, more preferably 0.13%-0.25%, and most preferably 0.14%-0.24%;

Cr: 0.8%-1.20%, preferably 0.85%-1.15%, more preferably 0.87%-1.12%, and most preferably 0.90%-1.10%;

Ni: 1.35%-1.65%, preferably 1.37%-1.64%, more preferably 1.39%-1.63%, and most preferably 1.50%-1.62%;

Mo: 0.35%-0.45%, preferably 0.36%-0.43%, more preferably 0.37%-0.42%, and most preferably 0.38%-0.40%;

V: 0.25%-0.35%, preferably 0.27%-0.34%, more preferably 0.28%-0.34%, and most preferably 0.30%-0.34%;

Cu: 0.85%-1.20%, preferably 0.87%-1.19%, more preferably 0.89%-1.18%, and most preferably 0.90%-1.17%;

Al: 0.015%-0.045%, preferably 0.018%-0.043%, more preferably 0.020%-0.042%, and most preferably 0.023%-0.040%;

S: ≤0.001%, preferably ≤0.0008%, more preferably 0.0001%-0.0008%, and most preferably 0.0002%-0.0005%;

P: ≤0.010%, preferably ≤0.009%, more preferably 0.001%-0.007%, and most preferably 0.001%-0.005%;

Sn: ≤0.010%, preferably 0.001%-0.009%, more preferably 0.002%-0.007%, and most preferably 0.003%-0.005%;

Sb: ≤0.008%, preferably 0.0001%-0.007%, more preferably 0.0002%-0.005%, and most preferably 0.0003%-0.002%;

As: ≤0.010%, preferably ≤0.008%, more preferably ≤0.007%, and most preferably 0.0001%-0.005%;

Pb: ≤0.008%, preferably 0.0001%-0.008%, more preferably 0.0002%-0.005%, and most preferably 0.0005%-0.002%;

H: ≤1.5 ppm, preferably ≤1.2 ppm, and more preferably ≤1.0 ppm;

O: ≤30 ppm, preferably ≤20 ppm, and more preferably ≤15 ppm; and

N: ≤70 ppm, preferably ≤60 ppm, and more preferably ≤50 ppm.

In addition to the foregoing components, the high pressure and corrosion resistant steel of the present invention further includes Fe, and the sum of the mass percentage of the Fe and the mass percentage of each of the foregoing components is 100%.

The high pressure and corrosion resistant steel of the present invention is a new type of structural steel containing Mn; a specific content of Mn can segregate austenite obtained from reverse transformation of quenched martensite to make the austenite stably exist at a room temperature and further obtain a dual-phase structure of tempered martensite and the austenite, thereby achieving the purpose of improving the toughness and fatigue life of the high pressure and corrosion resistant steel; the V within the content range can not only refine the grain size and improve the toughness of the material, but also form a nano-precipitation reinforcer VC with the C to improve the strength of the alloy material; the present invention also utilizes the Cr, Ni and Cu of the foregoing contents to form a composite corrosion-resistant design, and combines with a low-carbon design to greatly improve the corrosion resistance of the high pressure and corrosion resistant steel, making the generated steel material suitable for use in a harsh working environment.

The present invention provides a preparation method of the high pressure and corrosion resistant steel described in the foregoing technical solution, including following steps:

(1) sequentially smelting and casting raw materials corresponding to the respective components in the high pressure and corrosion resistant steel described in the foregoing technical solution to obtain a steel ingot;

(2) hot-forging the steel ingot to obtain a forged piece; and (3) heat-treating the forged piece to obtain the high-pressure and corrosion resistant steel.

The raw materials corresponding to the respective components of the high pressure and corrosion resistant steel of the present invention are described as follows: Fe and C are derived from pig iron, and Sn, Sb, As, and Pb elements are impurity elements in an alloy raw material, which do not need additional addition as their contents need to be controlled by a subsequent operation; P, H, N and O are unavoidable impurities, and do not need additional addition as their contents need to be controlled by a subsequent operation; the raw materials corresponding to the other components can be provided in a manner well known to those skilled in the art.

The present invention has no special requirement on the source of the materials, and a source well known to those skilled in the art can be used. In the specific implementation process of the present invention, in order to reduce cost, the pig iron can be replaced by scrap steel, and at the same time, a carbon content in the raw material is adjusted by a recarburizer to reduce a sulfur content. In the present invention, the recarburizer preferably includes one or more of wood carbon, coke and graphite, and is preferably graphite; the amount of the recarburizer is determined according to the composition of the carbon content in the scrap steel, so that the carbon content in the raw material can reach the content range of the C in the high pressure and corrosion resistant steel described in the foregoing technical solution.

After the raw materials corresponding to the respective components of the high pressure and corrosion resistant steel are supplied, the present invention smelts the supplied raw materials to obtain alloy liquid suitable for casting. In the present invention, the smelting preferably includes sequential fusion, refining, and degassing; the fusion is preferably carried out in an electric furnace; a fusion temperature is preferably 1,620-1,680° C.; and fusion time is preferably 60-70 min. The present invention preferably converts the raw materials into raw material liquid (molten steel) by fusion, and controls P and S contents in the raw material liquid, where the P content is controlled within a range of ≤0.015%, and the S content is controlled within a range of ≤0.005%.

After the raw material liquid is obtained, the present invention preferably refines the raw material liquid. In the present invention, the refining is preferably external refining, and is more preferably refining in a LF furnace (ladle refining furnace). In the present invention, when the raw material liquid is transferred from the electric furnace to the LF furnace, the temperature of the raw material liquid is preferably controlled at 1,620-1,680° C., so that the raw material liquid maintains good fluidity and can be completely transferred to the LF furnace.

In the present invention, when the refining is carried out, a refining reagent used preferably includes lime, aluminum oxide, sodium carbonate and fluorite; and the mass ratio of the lime, the aluminum oxide, the sodium carbonate and the fluorite is 20:(4.5-5.5):(1.8-2.4):(1.8-2.4). In the present invention, in the lime, the mass content of CaO is preferably >92%, and P is <0.015% and S is <0.008% in an impurity; the activity degree of the lime is preferably >360 mL; the particle size of the lime is preferably 10-30 mm, more preferably 12-28 mm, and most preferably 15-25 mm. The present invention has no special requirement on the amount of the refining agent, and an amount well known to those skilled in the art can be used.

In the present invention, a refining temperature is preferably 1,560-1,600° C., and more preferably 1,570-1,690° C.; refining time is preferably 180-200 min, and more preferably 185-195 min. The present invention controls the S in the molten steel to be ≤0.001% and controls the P to be ≤0.010% by refining.

After refining, the present invention preferably degases a refined material to obtain alloy liquid suitable for casting; the degassing is preferably vacuum degassing (VD); the present invention has no requirement on the specific implementation process of the vacuum degassing, provided that impurity gas in the alloy liquid can be controlled in the following range: H is ≤1.5 ppm, O is ≤30 ppm, and N is ≤70 ppm.

After smelting, the present invention casts the alloy liquid obtained by smelting to obtain a steel ingot. In the present invention, the casting method includes continuous casting or die casting; during casting, the temperature of the alloy liquid is preferably controlled within the range of 1,560-1,600° C. The present invention has no special requirement on the specific operation process of the casting, and an operation process well known to those skilled in the art can be used.

After casting, the present invention preferably detects the composition of an obtained cast billet; if the content of impurities exceeds the content range described in the foregoing technical solution, the cast billet is preferably electroslag-remelted. The present invention has no special requirement on the specific implementation of the electroslag remelting, and a manner well known to those skilled in the art can be used.

After casting, the present invention preferably removes the head and tail of the billet obtained after casting to eliminate the influence of a harmful contraction cavity and excessive segregation on the product, and obtain a steel ingot having a uniform composition.

After obtaining the steel ingot, the present invention hot-forges the steel ingot to obtain a forged piece. In the present invention, the hot-forging method preferably includes: insulating and then forging the steel ingot. In the present invention, the insulation preferably includes low-temperature insulation and high-temperature insulation; a low-temperature insulation temperature is preferably 850-900° C., more preferably 850-870° C., and low-temperature insulation time is preferably 6-7 h, and more preferably 6.5-7 h; a high-temperature insulation temperature is preferably 1,150-1,200° C., and more preferably 1,175-1,200° C., and high-temperature insulation time is preferably 9-10 h, and more preferably 9-9.5 h.

After insulation, the present invention forges the insulated steel ingot; the forging method is preferably triple upsetting triple drawing, to ensure uniform forging penetration in transverse and longitudinal directions of the steel ingot. In the forging process, the present invention preferably monitors the temperature of a steel ingot to be forged to ensure that the temperature of the steel ingot is maintained in the range of 850-1,200° C.; further, when the temperature of the steel ingot is lower than 850° C., the steel ingot needs to be reheated, and the high-temperature insulation treatment described in the foregoing technical solution is repeated prior to subsequent forging.

In the present invention, a deformation of the forged piece obtained after hot-forging is 45%-55%, more preferably 47%-52%, and most preferably 50%; and a total forging ratio (K) of the forged piece is preferably ≥5.

After obtaining the forged piece, the present invention heat-treats the forged piece to obtain the high pressure and corrosion resistant steel. In the present invention, when the obtained forged piece can satisfy a heat treatment requirement, the forged piece is heat-treated directly. If the obtained forged piece does not satisfy the heat treatment requirement, the forged piece needs to be annealed and roughened to obtain a specimen suitable for the heat treatment.

In the present invention, the heat treatment preferably includes a first stage of heat treatment, a second stage of heat treatment, and a third stage of heat treatment; and the method of the first stage of heat treatment is preferably:

heat the forged piece to 550±15° C., and wait for insulation;

heat the to-be-insulated forged piece to 650±15° C., and carry out $1^{st}$ insulation;

after the $1^{st}$ insulation, furnace-cool the forged piece to 300±15° C., and carry out $2^{nd}$ insulation;

after the $2^{nd}$ insulation, heat the forged piece to 450±15° C., and carry out $3^{rd}$ insulation;

after the $3^{rd}$ insulation, heat the forged piece to 750±15° C., and carry out $4^{th}$ insulation;

after the $4^{th}$ insulation, air-cool the forged piece to ≤300° C., and carry out $5^{th}$ insulation;

after the $5^{th}$ insulation, heat the forged piece to 450±15° C., and carry out $6^{th}$ insulation;

after the $6^{th}$ insulation, heat the forged piece to 750±15° C., and carry out $7^{th}$ insulation;

after the $7^{th}$ insulation, furnace-cool the forged piece to 280±15° C., and carry out $8^{th}$ insulation;

after the $8^{th}$ insulation, heat the forged piece to 680±15° C., and carry out $9^{th}$ insulation; and after the $9^{th}$ insulation, furnace-cool the forged piece to ≤65° C., and air-cool to room temperature.

In the present invention, $1^{st}$ insulation time is preferably 4-6 h;

$2^{nd}$ insulation time is preferably 5-7 h, more preferably 5.5-7 h, and most preferably 7 h;

$3^{rd}$ insulation time is preferably 7-9 h, more preferably 7.5-9 h, and most preferably 9 h;

$4^{th}$ insulation time is preferably 18-22 h, more preferably 19-22 h, and most preferably 22 h;

$5^{th}$ insulation time is preferably 5-7 h, more preferably 5.5-7 h, and most preferably 7 h;

$6^{th}$ insulation time is preferably 7-9 h, more preferably 7.5-9 h, and most preferably 9 h;

$7^{th}$ insulation time is preferably 17-20 h, more preferably 18-20 h, and most preferably 20 h;

$8^{th}$ insulation time is preferably 4-5 h, more preferably 4-5 h, and most preferably 5 h; and $9^{th}$ insulation time is preferably 55-58 h, more preferably 56-58 h, and most preferably 58 h.

The present invention anneals the forged piece obtained after forging by the first stage of heat treatment, and can play the following functions: firstly, adjusting the hardness of the forged piece to obtain a forged piece easy to be machined; secondly, eliminating an internal stress in the forged piece to avoid a deformation in the machining process; and thirdly, improving the internal structure of the forged piece and refining the grain size to prepare for the final heat treatment.

After the first stage of heat treatment is completed, the present invention preferably performs the second stage of heat treatment on the forged piece treated by the first stage of heat treatment, and the method of the second stage of heat treatment is preferably:

heat the forged piece treated by the first stage of heat treatment from a room temperature to 500±10° C., and carry out first insulation; then heat to 830-850° C., carry out second insulation, and air-cool to the room temperature;

then heat the forged piece from the room temperature to 500±10° C., and carry out third insulation; then heat to 830-850° C., carry out fourth insulation, and air-cool to the room temperature; and finally heat the forged piece from the room temperature to 600±10° C., and carry out fifth insulation; then heat to 580-620° C., carry out sixth insulation, and oil-cool to the room temperature.

In the present invention, first insulation time is preferably 2-4 h, more preferably 2.5-3.5 h, and most preferably 3 h;

second insulation time is preferably 6-8 h, more preferably 6.5-7.5 h, and most preferably 7 h;

third insulation time is preferably 2-4 h, more preferably 2.5-3.5 h, and most preferably 3 h;

fourth insulation time is preferably 6-8 h, more preferably 6.5-7.5 h, and most preferably 7 h;

fifth insulation time is preferably 2-4 h, more preferably 2.5-3.5 h, and most preferably 3 h; and sixth insulation time is preferably 6-8 h, more preferably 6.5-7.5 h, and most preferably 7 h.

The present invention has no special requirement on the heating rate in the second stage of heat treatment, and a heating rate well known to those skilled in the art can be used. The present invention normalizes the forged piece by the second stage of heat treatment, and can form quenched martensite in the forged piece, providing a basis for obtaining a dual-phase structure of martensite and austenite.

After the second stage of heat treatment is completed, the present invention preferably performs the third stage of heat treatment on the forged piece treated by the second stage of heat treatment, and the method of the third stage of heat treatment is preferably:

heat the forged piece treated by the second stage of heat treatment from a room temperature to 350±10° C., and carry out I-th insulation; then heat to 580-620° C., carry out II-th insulation, and air-cool to the room temperature.

In the present invention, I-th insulation time is preferably 2-4 h, more preferably 2.5-3.5 h, and most preferably 3 h;

II-th insulation time is preferably 10-14 h, more preferably 11-13 h, and most preferably 12 h.

It should be noted that, after the I-th insulation and the II-th insulation are completed, the present invention preferably detects the hardness of the forged piece obtained after the II-th insulation; when the hardness of the forged piece exceeds the range of 320-360 HBW (below the lowest value or higher than the highest value), the present invention preferably repeats the I-th insulation and the II-th insulation described in the foregoing technical solution to control the hardness of the forged piece between 320 and 360 HBW.

The present invention preferably tempers the forged piece by the third stage of heat treatment described in the foregoing technical solution to reversely transform the quenched martensite treated by the second stage of heat treatment to austenite, and segregates the austenite by element Mn in the third stage of heat treatment to make the austenite stably exist at the room temperature and further obtain the dual-phase structure of the tempered martensite and the austenite, thereby improving the toughness and fatigue life of the steel; besides, in the third stage of heat treatment, a nano-precipitation reinforcer VC is separated out to further improve the strength property of the alloy and finally obtain the high pressure and corrosion resistant steel with a remarkable improvement in overall performance and a significant reduction in cost.

The present invention further provides an application of the high pressure and corrosion resistant steel described in the foregoing technical solution or a high pressure and corrosion resistant steel prepared by the preparation method described in the foregoing technical solution as a material for manufacturing a fluid end valve chamber of a fracturing pump. The present invention has no special requirement on the specific mode of the application, and an application mode well known to those skilled in the art can be used.

To further describe the present invention, the following describes the high pressure and corrosion steel and the preparation method and application thereof provided by the present invention in detail below in combination with the embodiments, but the embodiments should not be interpreted as a limitation to the protection scope of the present invention.

Embodiment 1

Raw materials are mixed according to the proportion as shown in Table 1.

Specific preparation steps are as follows.

Step 1: smelting: electric furnace fusion+ladle furnace (LF) refining+vacuum degassing (VD) treatment+continuous casting:

1. molten iron pretreatment: pretreat molten iron in a furnace until the content of S is decreased to 0.008% and the content of P is decreased to 0.015%; and 2. electric furnace fusion: mix raw materials according to the proportion in Table 1 (total weight of the molten iron is 100 tons), fuse in an electric furnace for 60 min, then transfer to a LF furnace, add a refining agent (added according to 0.3% the total weight of the molten iron, and including the components of lime, aluminum oxide, sodium carbonate and fluorite having a mass ratio of 20:5:2:2), refine at 1,600° C. for 200 min, vacuum-degas till the P and S contents in the molten steel are 0.015% and 0.005% respectively, continuously cast, and then remove billet head and tail waste to eliminate a harmful contraction cavity and excessive segregation, to obtain a steel ingot.

Step 2: heat and insulate the steel ingot by a heating furnace in stages; firstly heat the steel ingot to 850° C., insulate for 7 h, then heat to 1,200° C., insulate for 9 h, and forge the steel ingot to obtain a forged piece, where during forging, forging hammer equipment with an appropriate tonnage (a 6,000-ton press is used in this embodiment) is selected to ensure a good compaction effect in the center of the forged piece; a material deformation is 45%-55%; a total forging ratio (K) of the forged piece is ≥5; triple upsetting triple drawing is performed to ensure uniform forging penetration in transverse and longitudinal directions; the temperature is necessarily monitored during the forging process; if the forging temperature is lower than 850° C., the forged piece must be reheated to 1,200° C. and insulated for 8 h.

Step 3: after forging, the forged piece is loaded into a normalizing furnace for heat treatment; a first stage of heat treatment is specifically carried out as follows:

heat to 550° C., and wait for insulation; heat to 650° C., and insulate for 5 h; furnace-cool to 300° C., and insulate for 6 h; then heat to 450° C., ensuring a heating rate of 25° C./h, and insulate at 450° C. for 8 h; heat to 750° C., ensuring a heating rate of 75° C./h, and insulate at 750° C. for 20 h; air-cool to ≤300° C., and insulate for 6 h; then heat to 450° C., and insulate for 8 h; heat to 750° C., and insulate for 18 h; furnace-cool to 280° C., and insulate for 4 h; then heat to 680° C., ensuring a heating rate of 66° C./h, and insulate at 680° C. for 56 h; and furnace-cool to 65° C., with a hardness ≤260 HBW;

a second stage of heat treatment is specifically as follows: load the forged piece treated by the first stage of heat treatment into a furnace at room temperature; heat to 600° C., and insulate for 3 h; heat to 900° C., and insulate for 7 h; air-cool to the room temperature; then continue to load the forged piece into the furnace at room temperature; heat to 600° C., and insulate for 3 h; heat to 900° C., and insulate for 7 h; air-cool to the room temperature; normalize twice to refine the grain size of the forged piece; continue to load the forged piece into the furnace at the room temperature; heat to 600° C., and insulate for 3 h; heat to 850° C., and insulate for 7 h; oil-cool to the room temperature; oil-quench to prevent the forged piece from cracking; and check the hardness; and a third stage of heat treatment is specifically as follows: determine a tempering temperature based on the hardness value measured in the previous step; load the forged piece into a furnace at the room temperature; heat to 350° C., and insulate for 3 h; heat to 560° C., and insulate for 12 h; air-cool to the room temperature; check the hardness; and determine whether second tempering is necessary and determine a second tempering temperature according to the hardness value, where in this embodiment, second tempering is necessary, specifically, load the forged piece into a furnace at the room temperature, heat to 350° C., insulate for 3 h, heat to 560° C., insulate for 12 h, air-cool to the room temperature, and check the hardness.

Embodiments 2-5

A composition is shown in Table 1; high pressure and corrosion resistant steel is prepared in accordance with the method in Embodiment 1, and the differences are shown in Table 2.

TABLE 1

Composition of high pressure and corrosion resistant steel in Embodiments 1-5 (%)

| Composition | Embodiment 1 | Embodiment 2 | Embodiment 3 | Embodiment 4 | Embodiment 5 |
|---|---|---|---|---|---|
| C | 0.05 | 0.08 | 0.09 | 0.12 | 0.10 |
| Mn | 3.35 | 3.41 | 3.45 | 3.52 | 3.37 |
| Si | 0.20 | 0.23 | 0.17 | 0.15 | 0.25 |
| Cr | 1.0 | 1.03 | 1.12 | 0.91 | 1.07 |
| Ni | 1.45 | 1.50 | 1.37 | 1.52 | 1.60 |
| Mo | 0.37 | 0.40 | 0.42 | 0.39 | 0.44 |
| V | 0.28 | 0.30 | 0.35 | 0.27 | 0.33 |
| Cu | 1.10 | 0.90 | 1.00 | 1.05 | 1.15 |
| Al | 0.020 | 0.030 | 0.035 | 0.025 | 0.040 |
| S | 0.0008 | 0.0005 | 0.0006 | 0.0002 | 0.0009 |
| P | 0.005 | 0.10 | 0.009 | 0.003 | 0.006 |
| Sn | 0.005 | 0.010 | 0.008 | 0.004 | 0.007 |
| Sb | 0008 | 0.001 | 0.005 | 0.008 | 0.003 |
| As | 0.010 | 0.008 | 0.005 | 0.009 | 0.007 |
| Pb | 0.008 | 0.005 | 0.008 | 0.006 | 0.005 |
| H (ppm) | 1.2 | 1.5 | 1.0 | 1.4 | 1.5 |
| O (ppm) | 30 | 25 | 28 | 24 | 30 |
| N (ppm) | 65 | 50 | 55 | 70 | 67 |
| Fe | Balance | Balance | Balance | Balance | Balance |

TABLE 2

Preparation process parameters of high pressure and corrosion resistant steel in Embodiments 1-5

| Process step parameters | Embodiment 1 | Embodiment 2 | Embodiment 3 | Embodiment 4 | Embodiment 5 |
|---|---|---|---|---|---|
| Fusion temperature (° C.) | 1620 | 1650 | 1675 | 1645 | 1630 |
| Forging maintained temperature (° C.) | 850-1200 | 900-1000 | 950-1200 | 1000-1100 | 950-1150 |
| Forging deformation (%) | 50 | 55 | 45 | 50 | 50 |
| Total forging ratio of forged piece | 5.0 | 7.0 | 5.5 | 6.5 | 6.0 |
| $1^{st}$ insulation temperature (° C.) | 650 | 645 | 637 | 655 | 663 |
| $1^{st}$ insulation time (h) | 5 | 4.5 | 6 | 4 | 5 |
| $2^{nd}$ insulation temperature (° C.) | 300 | 295 | 305 | 300 | 310 |
| $2^{nd}$ insulation time (h) | 6 | 6.5 | 7 | 5 | 5.5 |
| $3^{rd}$ insulation temperature (° C.) | 450 | 455 | 460 | 465 | 440 |
| $3^{rd}$ insulation time (h) | 8 | 7.5 | 7 | 8 | 9 |
| $4^{th}$ insulation temperature (° C.) | 750 | 765 | 760 | 755 | 740 |
| $4^{th}$ insulation time (h) | 8 | 8.5 | 8 | 7.5 | 9 |
| $5^{th}$ insulation temperature (° C.) | 300 | 280 | 290 | 300 | 285 |
| $5^{th}$ insulation time (h) | 6 | 5 | 5.5 | 5 | 7 |
| $6^{th}$insulation temperature (° C.) | 450 | 445 | 455 | 465 | 460 |
| $6^{th}$insulation time (h) | 8 | 9 | 7.5 | 8.5 | 9 |
| $7^{th}$ insulation temperature (° C.) | 750 | 760 | 745 | 765 | 750 |
| $7^{th}$ insulation time (h) | 18 | 19 | 20 | 17 | 18 |
| $8^{th}$ insulation temperature (° C.) | 280 | 290 | 270 | 275 | 285 |
| $8^{th}$ insulation time (h) | 4 | 4.5 | 5 | 4 | 5 |
| $9^{th}$ insulation temperature (° C.) | 680 | 685 | 670 | 690 | 685 |
| $9^{th}$ insulation time (h) | 56 | 57 | 58 | 56 | 57 |
| First insulation temperature (° C.) | 600 | 595 | 605 | 610 | 603 |
| First insulation time (h) | 3 | 3.5 | 3 | 2 | 2.5 |
| Second insulation temperature (° C.) | 900 | 920 | 910 | 915 | 900 |
| Second insulation time (h) | 7 | 6.5 | 6 | 7.5 | 8 |
| Third insulation temperature (° C.) | 600 | 595 | 605 | 610 | 603 |
| Third insulation time (h) | 3 | 3.5 | 3 | 2 | 2.5 |
| Fourth insulation temperature (° C.) | 900 | 920 | 910 | 915 | 900 |
| Fourth insulation time (h) | 7 | 6.5 | 6 | 7.5 | 8 |
| Fifth insulation temperature (° C.) | 600 | 595 | 605 | 610 | 603 |
| Fifth insulation time (h) | 3 | 3.5 | 3 | 2 | 2.5 |
| Sixth insulation temperature (° C.) | 850 | 870 | 860 | 855 | 865 |
| Sixth insulation time (h) | 7 | 5.5 | 6 | 6.5 | 7 |
| I-th insulation temperature (° C.) | 350 | 360 | 345 | 355 | 340 |
| I-th insulation time (h) | 3 | 3.5 | 3 | 3.5 | 4 |
| II-th insulation temperature (° C.) | 560 | 630 | 585 | 600 | 625 |
| II-th insulation time (h) | 12 | 10 | 15 | 11 | 10 |
| Whether to repeat I-th and II-th insulation | Yes | No | No | No | No |

Remarks: In Table 2, the 1st to 9th insulation refers to the parameters of the first stage of heat treatment, the first to sixth insulation refers to the parameters of the second stage of heat treatment, and the I-th to II-th insulation refers to the third stage of heat treatment; except for the foregoing parameters, the other parameters of Embodiments 2 to 5 are the same as those of Embodiment 1.

Property Characterization and Results

Test mechanical properties of the high pressure and corrosion resistant steel according to the ASTM A370 Test Method and Definition Standard for Mechanical Properties of Steel Products;

Test a hardness property of the high pressure and corrosion resistant steel according to the ASTM E10 Test Method for Brinell Hardness of Metallic Materials;

Use a steel material with an artificial crack as a test specimen, test corrosion resistance by using hydrochloric acid with a mass concentration of 20%, and compare the elongation of the crack with reference to an alloy used in a fluid end valve chamber of an existing fracturing pump, to characterize the corrosion resistance of the test specimen; and Prepare the obtained high pressure and corrosion resistant steel into a fluid end valve chamber of a fracturing pump, and test the service life of the high pressure and corrosion resistant steel in use under the condition of 80-140 MPa pressure, 20% mass concentration hydraulic acid and 1 $m^3$/min displacement.

The results of the foregoing tests are listed in Table 3.

TABLE 3

Property test results of high pressure and corrosion resistant steel in Embodiments 1-5

| Properties | Embodiment 1 | Embodiment 2 | Embodiment 3 | Embodiment 4 | Embodiment 5 |
|---|---|---|---|---|---|
| Tensile strength (MPa) | 1100 | 1045 | 1020 | 1077 | 1091 |
| Yield strength (MPa) | 1050 | 1032 | 982 | 995 | 1044 |
| Elongation (%) | 21.8 | 22.0 | 20.1 | 21.2 | 21.5 |
| Reduction of area (%) | 75 | 68 | 62 | 71 | 77 |
| −40° C. impact energy (J) | 100 | 110 | 120 | 125 | 105 |
| Hardness HBW | 340 | 355 | 358 | 331 | 328 |
| Crack propagation under acid | There is no obvious change of propagation compared with an alloy used in a fluid end valve chamber of an existing fracturing pump | | | | |
| Service life (h) | 350 | 310 | 300 | 300 | 320 |

It can be seen from the test results of Table 3 that, the high pressure and corrosion resistant steel provided by the present invention has a tensile strength of 1,020-1,100 MPa, a yield strength of 980-1,050 MPa, an elongation of 20%-22%, a reduction of area of 60%-80%, impact energy of 120 J or more at a low temperature of −40° C., and a hardness up to 320-360 HBW, and can resist corrosion of hydrochloric acid with a mass concentration of 20%, and can achieve a service life of 300 h or more in a high-pressure and acidic environment, indicating that the alloy steel provided by the present invention can be used for preparing a fluid end valve chamber of a fracturing pump.

It can be seen from the foregoing embodiments that, the alloy steel provided by the present invention has a reasonable composition, and the alloy steel having the composition has excellent strength, elongation, reduction of area, low-temperature toughness, hardness and corrosion resistance, and is suitable for a fracturing environment, providing a basic condition for the use and development of fracturing technology.

The preparation method provided by the present invention can obtain alloy steel having the foregoing properties, and the method has good repeatability and can be industrially popularized and used.

Although the aforementioned embodiments illustrate the present invention in detail, they are only parts of the embodiments of the present invention, rather than all of the embodiments. Other embodiments can be obtained by people according to these embodiments without the premise of inventiveness, and all of the embodiments fall within the claimed scope of the present invention.

What is claimed is:

1. A preparation method of a high pressure and corrosion resistant steel, comprising the following steps:

(1) sequentially smelting and casting raw materials corresponding to the respective components in the high pressure and corrosion resistant steel to obtain a steel ingot;

(2) hot-forging the steel ingot to obtain a forged piece; and (3) heat-treating the forged piece to obtain the high pressure and corrosion resistant steel;

wherein the high pressure and corrosion resistant steel comprises the following components by mass percentage: 0.05%-0.15% of C, 3.35%-3.65% of Mn, 0.10%-0.28% of Si, 0.8%-1.20% of Cr, 1.35%-1,65% of Ni, 0.35%-0.45% of Mo, 0.25%-0.35% of V, 0.85%-1.20% of Cu, 0.015%-0.045% of Al, <0.001% of S, <0.010% of P, <0,010% of Sn, <0.008% of Sb, <0.010% of As, <0.0 08% of Pb, <1.5 ppm of H, <30 ppm of O, <70 ppm of N, and the balance being Fe, wherein the high pressure and corrosion resistant steel is resistant to a pressure of 80 140 MPa, wherein in step (3), the heat treatment comprises a first stage of heat treatment, a second stage of heat treatment and a third stage of heat treatment; the method of the first stage of heat treatment comprises: heating the forged piece to 550±15° C., and waiting for insulation; heating the to-be-insulated forged piece to 650±15° C., and carrying out 1st insulation: after the 1st insulation, furnace-cooling the forged piece to 300±15° C., and carrying out 2nd insulation, after the 2nd insulation, heating the forged piece to 450±15° C., and carrying out 3rd insulation, after the 3rd insulation, heating the forged piece to 750±15° C., and carrying out 4th insulation: after the 4th insulation, air-cooling the forged piece to <300° C., and carrying out 5th insulation, after the 5th insulation, heating the forged piece to 450 4±15° C. and carrying out 6th insulation: after the 6th insulation, heating the forged piece to 750±1.5'C, and carrying out 7th insulation, after the 7th insulation, furnace-cooling the forged piece to 280+1.5° C., and carrying out 8th insulation: after the 8th insulation, heating the forged piece to 680+15° C., and carrying out 9th insulation; and after the 9th insulation, furnace-cooling the forged piece to <=65° C., and air-cooling to a room temperature.

2. The preparation method according to claim 1, wherein the high pressure and corrosion resistant steel comprises the following components by mass percentage: 0.05%-0.12% of C, 3.37%-3.63% of Mn, 0.12%-0.27% of Si, 0.85%-1.15% of Cr, 1.35%-1.65% of Ni, 0.35%-0.45% of Mo, 0.27%-0.34% of V, 0.87%-1.19% of Cu, 0.018%-0.043% of Al, ≤0.0008% of S, ≤0.009% of P, 0.001%-0.009% of Sn, 0.0001%-0.007% of Sb, ≤0.008% of As, 0.0001%-0.008% of Pb, ≤1.2 ppm of H, ≤25 ppm of O, ≤67 ppm of N, and the balance being Fe.

3. The preparation method according to claim 1, wherein in step (1), the smelting comprises sequential fusion, refining and degassing.

4. The preparation method according to claim 2, wherein in step (1), the smelting comprises sequential fusion, refining and degassing.

5. The preparation method according to claim 1, wherein in step (2), a hot-forging temperature is 850-1,200° C., and a deformation is 45%-55%.

6. The preparation method according to claim 2, wherein in step (2), a hot-forging temperature is 850-1,200° C., and a deformation is 45%-55%.

7. The preparation method according to claim 1 wherein in step (2), a total forging ratio of hot-forging is ≥5.

8. The preparation method according to claim 2, wherein in step (2), a total forging ratio of hot-forging is ≥5.

9. The preparation method according to claim 5, wherein in step (2), a total forging ratio of hot-forging is ≥5.

10. The preparation method according to claim 6, wherein in step (2), a total forging ratio of hot-forging is ≥5.

11. The preparation method according to claim 1, wherein the method of the second stage of heat treatment is as follows:

heating the forged piece treated by the first stage of heat treatment from the room temperature to 500±10° C., and carrying out first insulation; then heating to 830-850° C., carrying out second insulation, and air-cooling to the room temperature;

then heating the forged piece from the room temperature to 500±10° C., and carrying out third insulation; then heating to 830-850° C., carrying out fourth insulation, and air-cooling to the room temperature; and finally heating the forged piece from the room temperature to 600±10° C., and carrying out fifth insulation; then heating to 580-620° C., carrying out sixth insulation, and oil-cooling to the room temperature.

12. The preparation method according to claim 2 wherein the method of the second stage of heat treatment is as follows:

heating the forged piece treated by the first stage of heat treatment from the room temperature to 500±10° C., and carrying out first insulation; then heating to 830-850° C., carrying out second insulation, and air-cooling to the room temperature;

then heating the forged piece from the room temperature to 500±10° C., and carrying out third insulation; then heating to 830-850° C., carrying out fourth insulation, and air-cooling to the room temperature; and finally heating the forged piece from the room temperature to 600±10° C., and carrying out fifth insulation; then heating to 580-620° C., carrying out sixth insulation, and oil-cooling to the room temperature.

13. The preparation method according to claim 1, wherein the method of the third stage of heat treatment is as follows:

heating the forged piece treated by the second stage of heat treatment from the room temperature to 350±10° C., and carrying out I-th insulation; then heating to 580-620° C., carrying out II-th insulation, and air-cooling to the room temperature.

14. The preparation method according to claim 2, wherein the method of the third stage of heat treatment is as follows:

heating the forged piece treated by the second stage of heat treatment from the room temperature to 350±10° C., and carrying out I-th insulation; then heating to 580-620° C., carrying out II-th insulation, and air-cooling to the room temperature.

15. The preparation method according to claim 11, wherein the method of the third stage of heat treatment is as follows:

heating the forged piece treated by the second stage of heat treatment from the room temperature to 350±10° C., and carrying out I-th insulation; then heating to 580-620° C., carrying out II-th insulation, and air-cooling to the room temperature.

16. The preparation method according to claim 12, wherein the method of the third stage of heat treatment is as follows:

heating the forged piece treated by the second stage of heat treatment from the room temperature to 350±10° C., and carrying out I-th insulation; then heating to 580-620° C., carrying out II-th insulation, and air-cooling to the room temperature.

* * * * *